US011489299B2

(12) United States Patent
Nakamura

(10) Patent No.: US 11,489,299 B2
(45) Date of Patent: Nov. 1, 2022

(54) PROCESSING APPARATUS

(71) Applicant: DISCO CORPORATION, Tokyo (JP)

(72) Inventor: Masaru Nakamura, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/201,571

(22) Filed: Mar. 15, 2021

(65) Prior Publication Data

US 2021/0313747 A1 Oct. 7, 2021

(30) Foreign Application Priority Data

Apr. 7, 2020 (JP) ..... JP2020-068811

(51) Int. Cl.
*H01R 13/74* (2006.01)

(52) U.S. Cl.
CPC ..... *H01R 13/74* (2013.01)

(58) Field of Classification Search
CPC ..... H01R 13/74; H01R 13/73
USPC ..... 439/571
See application file for complete search history.

(56) References Cited

U.S. PATENT DOCUMENTS

| | | | | |
|---|---|---|---|---|
| 4,373,761 | A * | 2/1983 | Hansberry, Jr. | B25H 5/00 182/132 |
| 5,330,469 | A * | 7/1994 | Fleenor | A61B 18/14 606/34 |
| 8,608,260 | B2 * | 12/2013 | Wishlade | B25H 1/12 312/319.8 |
| 9,849,584 | B1 * | 12/2017 | Liu | B25H 1/16 |
| 10,486,722 | B2 * | 11/2019 | Alves De Moraes | B60B 33/00 |
| 10,730,177 | B2 * | 8/2020 | Liu | H01R 13/516 |
| 2009/0260547 | A1 * | 10/2009 | Epstein | H04N 5/66 108/50.02 |
| 2018/0301855 | A1 * | 10/2018 | Lu | H01R 27/02 |
| 2020/0171646 | A1 * | 6/2020 | Liu | H02G 11/02 |

FOREIGN PATENT DOCUMENTS

| | | | |
|---|---|---|---|
| JP | 2009148784 | * | 7/2009 |
| JP | 2018083252 | A | 5/2018 |
| JP | 2018192546 | A | 12/2018 |

* cited by examiner

*Primary Examiner* — Harshad C Patel
(74) *Attorney, Agent, or Firm* — Greer Burns & Crain, Ltd.

(57) ABSTRACT

A processing apparatus includes a chuck table that holds a workpiece, a processing unit that processes the workpiece held by the chuck table, and a panel that surrounds components including the chuck table and the processing unit. Power source sockets are disposed on the panel, and electric apparatuses including an inspection device, a personal computer, a fan, and a cleaner are connected to the power source sockets and are used.

7 Claims, 2 Drawing Sheets

PROCESSING APPARATUS

BACKGROUND OF THE INVENTION

Field of the Invention

The present invention relates to a processing apparatus including a chuck table that holds a workpiece, a processing unit that processes the workpiece held by the chuck table, and a panel that surrounds components including the chuck table and the processing unit.

Description of the Related Art

A wafer formed on a front surface thereof with a plurality of devices such as integrated circuits (ICs) and large-scale integrations (LSIs) partitioned by a plurality of intersecting streets is put to grinding of a back surface by a grinding apparatus, to be processed to a desired thickness, after which the wafer is divided into individual device chips by a dicing apparatus or a laser processing apparatus, and the divided device chips are used for electric apparatuses such as mobile phones and personal computers (see, for example, Japanese Patent Laid-open No. 2018-83252 and Japanese Patent Laid-open No. 2018-192546).

SUMMARY OF THE INVENTION

However, in the case of using, for example, an oscilloscope for detecting vibration of a processing apparatus including a grinding apparatus, a dicing apparatus, and a laser processing apparatus, it is necessary to insert a plug of an extension cord into a power source socket installed in the plant and to wire to the processing apparatus, which is troublesome.

Accordingly, it is an object of the present invention to provide a processing apparatus permitting electric apparatuses to be easily used near the processing apparatus.

In accordance with an aspect of the present invention, there is provided a processing apparatus including a chuck table that holds a workpiece, a processing unit that processes the workpiece held by the chuck table, a panel that surrounds components including the chuck table and the processing unit, and power source sockets disposed on the panel. Electric apparatuses that include an inspection device, a personal computer, a fan, and a cleaner are connected to the power source sockets and are used.

Preferably, the power sockets are disposed on a front side, a lateral side, or a rear side of the panel. Preferably, the voltage of the power source sockets is any one of 100 V, 200 V, and 240 V.

According to the present invention, the power source sockets are disposed on the panel, and electric apparatuses including an inspection device, a personal computer, a fan, and a cleaner can be used, such that the electric apparatuses can be easily used near the processing apparatus.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
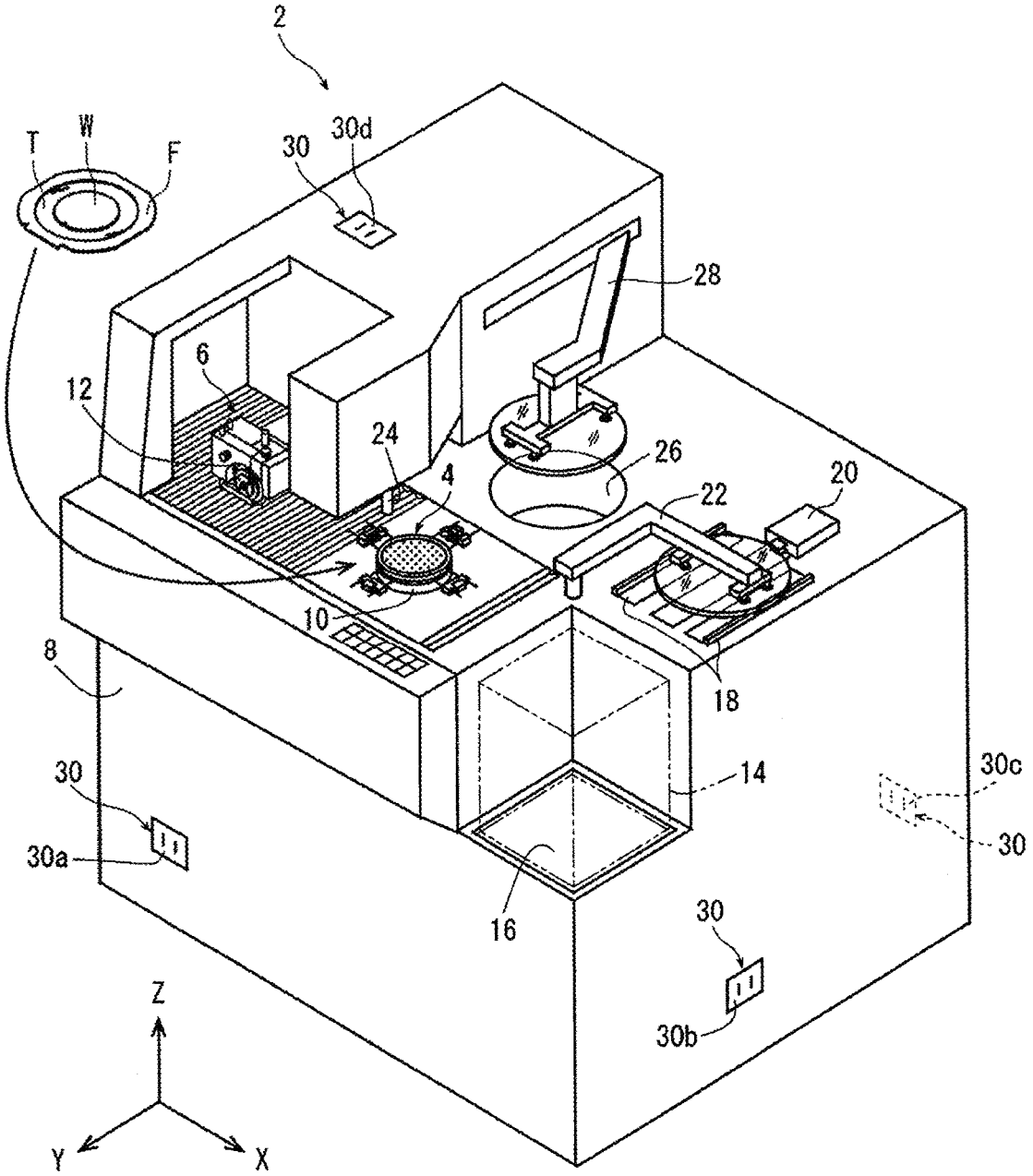
FIG. 1 is a perspective view of a processing apparatus according to an embodiment of the present invention.

A processing apparatus according to an embodiment of the present invention will be described below referring to the drawings.

Referring to FIG. 1, the processing apparatus denoted by a sign 2 as a whole includes a holding unit 4 that holds a workpiece, a processing unit 6 that processes the workpiece held by the holding unit 4, and a panel 8 that surrounds components including the holding unit 4 and the processing unit 6.

The holding unit 4 includes a circular chuck table 10 disposed to be movable in an X-axis direction indicated by an arrow X in FIG. 1. The chuck table 10 is rotated by a motor (not illustrated) and is moved in the X-axis direction by an X-axis feeding mechanism (not illustrated). Note that a Y-axis direction indicated by an arrow Y in FIG. 1 is a direction orthogonal to the X-axis direction, and a Z-axis direction indicated by an arrow Z in FIG. 1 is a vertical direction orthogonal to the X-axis direction and the Y-axis direction. An XY plane defined by the X-axis direction and the Y-axis direction is substantially horizontal.

An upper end portion of the chuck table 10 is formed from a porous member connected to suction means (not illustrated). With a suction force generated at an upper surface of the chuck table 10 by the suction means, the holding unit 4 suction holds the workpiece such as a wafer W placed on the upper surface of the chuck table 10. Note that the wafer W depicted in FIG. 1 is adhered to an adhesive tape T of which a peripheral edge is fixed to an annular frame F.

The processing unit 6 includes a cutting blade 12 disposed to be rotatable with the Y-axis direction as an axis, and a motor (not illustrated) for rotating the cutting blade 12. The processing unit 6 cuts the workpiece held by the chuck table 10 by the cutting blade 12 rotated by the motor. Thus, the processing unit 6 in the present embodiment is a cutting unit that cuts the workpiece held by the holding unit 4. Note that the processing unit 6 may be a laser processing unit that performs laser processing on the workpiece held by the holding unit 4, a grinding unit that grinds the workpiece held by the holding unit 4, or the like.

As illustrated in FIG. 1, the processing apparatus 2 further includes a cassette mount base 16 on which a cassette 14 accommodating a plurality of wafers W supported by the annular frames F through the adhesive tapes T is mounted and which can be lifted up and down, lifting means (not illustrated) that lifts the cassette mount base 16 up and down, a carrying-in/out mechanism 20 that draws out the wafer W yet to be cut from the cassette 14, carries the wafer W to a temporary placing table 18, and carries in the wafer W that is positioned on the temporary placing table 18 and that has been cut into the cassette 14, a first carrying mechanism 22 that carries the wafer W yet to be cut which is carried out from the cassette 14 to the temporary placing table 18 to the chuck table 10, an imaging unit 24 that images the wafer W held by the chuck table 10, a cleaning unit 26 that cleans the wafer W having been cut, and a second carrying mechanism 28 that carries the wafer W having been cut from the chuck table 10 to the cleaning unit 26.

The panel 8 surrounds the components of the processing apparatus 2 as described above. The panel 8 depicted in FIG. 1 is not depicted in the mode of surrounding the upper side of some of the components of the described above processing apparatus 2, for convenience, but may be configured to surround the upper side of the all of the components of the described above processing apparatus 2.

Power source sockets or power source outlets 30 are disposed on the panel 8, and electric apparatuses including an inspection device, a personal computer, a fan, and a cleaner can be used. The power source sockets 30 in the present embodiment include a front socket 30*a* disposed on the front side (on the viewer's side in the Y-axis direction in FIG. 1) of the panel 8, a side socket 30*b* disposed on a lateral side (on the viewer's side in the X-axis direction in FIG. 1) of the panel 8, a rear socket 30*c* disposed on the rear side (on the depth side in the Y-axis direction in FIG. 1) of the panel 8, and an upper socket 30*d* disposed on the upper side of the panel 8, but the layout and the number of the power source sockets 30 can be set optionally. The voltage of the power source sockets 30 is preferably any one of 100V, 200V, and 240 V of single-phase alternating current (AC). Note that in FIG. 1, the power source sockets 30 are depicted in an exaggerated form.

Figure 2:
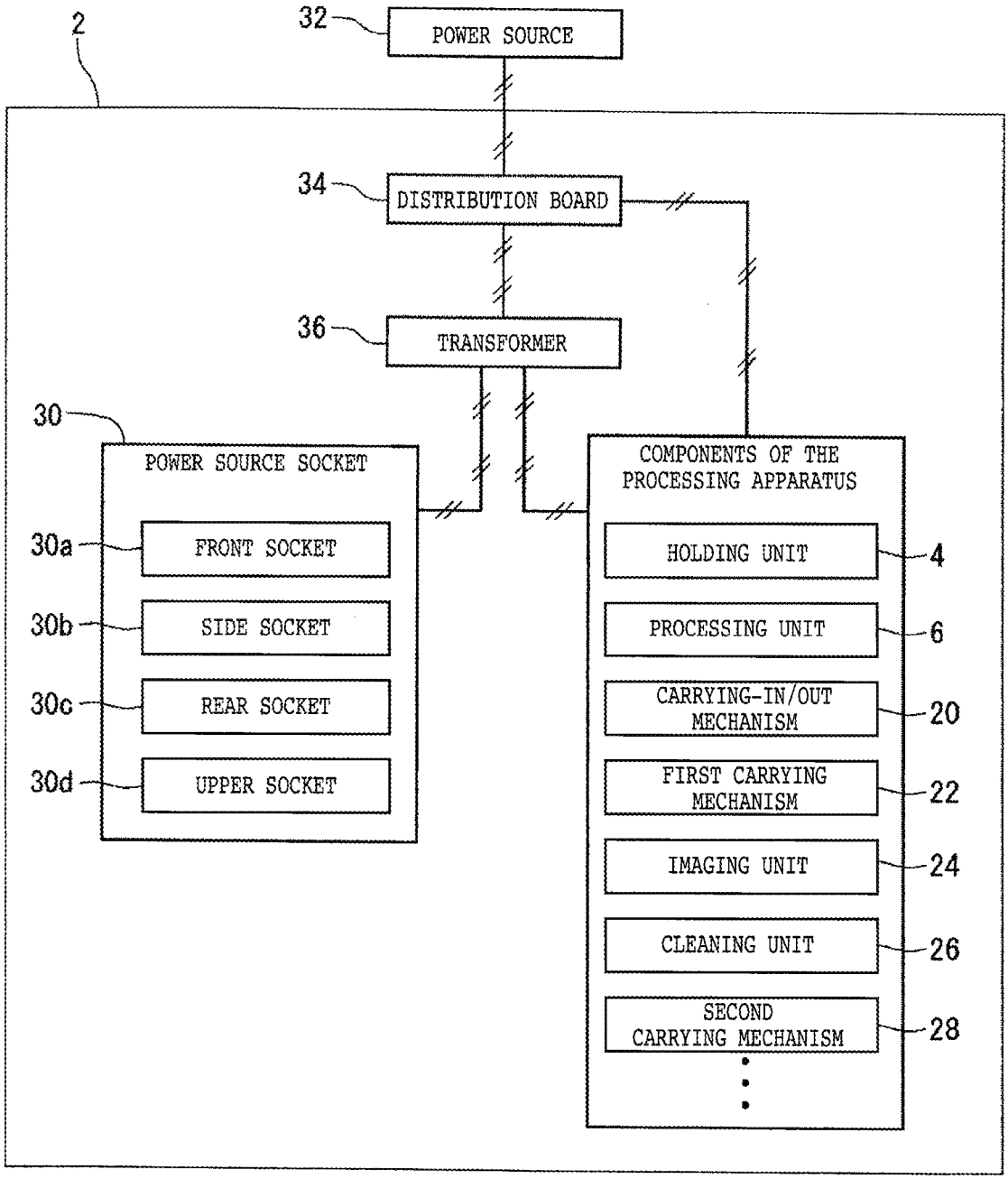
FIG. 2 is a block diagram of the processing apparatus depicted in FIG. 1.

Referring to FIG. 2, the processing apparatus 2 includes a distribution board 34 connected to an external power source 32, and a transformer 36 connected to the distribution board 34. The external power source 32 may be, for example, three-phase AC power source of a voltage of 200 V. The transformer 36 converts the voltage of the power supplied to the distribution board 34 into, for example, any one of 100 V, 200V, and 240 V of single-phase AC. As illustrated in FIG. 2, the power source sockets 30 are connected to the transformer 36, and the components of the processing apparatus 2 such as the holding unit 4 and the processing unit 6 are connected to the transformer 36. In addition, the components of the processing apparatus 2 such as the holding unit 4 and the processing unit 6 may be connected, not through the transformer 36, but directly to the distribution board 34.

In cutting the wafer W by use of the processing apparatus 2, first, the wafer W is carried out from the cassette 14 to the temporary placing table 18 by the carrying-in/out mechanism 20. Next, the wafer W positioned on the temporary placing table 18 is carried onto the chuck table 10 by the first carrying mechanism 22, and the wafer W is suction held on an upper surface of the chuck table 10. Subsequently, the wafer W is imaged from above by the imaging unit 24, and based on the image of the wafer W picked up by the imaging unit 24, the orientation of the wafer W is adjusted, and alignment between a region for cutting the wafer W and the cutting blade 12 is performed. Next, a cutting edge of the cutting blade 12 rotating at a high speed is caused to cut into the wafer W, and the chuck table 10 is subjected to processing feeding in the X-axis direction by the X-axis feeding mechanism, thereby cutting the wafer W.

In addition, in the case of using, for example, an oscilloscope (not illustrated) for detecting vibration of the processing apparatus 2, a power source plug of the oscilloscope is inserted into any one of the front socket 30*a*, the side socket 30*b*, the rear socket 30*c*, and the upper socket 30*d*, whereby the oscilloscope can be used near the processing apparatus 2.

As described above, according to the processing apparatus 2 of the present embodiment, electric apparatuses including an inspection device, a personal computer, a fan, and a cleaner can be used near the processing apparatus 2 by inserting the power source plugs of the electric apparatuses into the power source sockets 30, and therefore, it is unnecessary to insert a plug of an extension cord into the power source socket installed in the plant and to wire to the processing apparatus 2.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A processing apparatus comprising:

a chuck table that holds a workpiece;

a processing unit that processes the workpiece held by the chuck table;

a panel that surrounds components including the chuck table and the processing unit;

a distribution board electrically connected to an external power source;

a transformer electrically connected to the distribution board, wherein the transformer is configured and arranged to convert the voltage received from the distribution board, and power source sockets disposed on the panel, wherein the power source sockets are electrically connected to the transformer, a carrying mechanism configured and arranged for carrying the workpiece; and a holding unit configured and arranged to hold the workpiece on the chuck table via suction, wherein the holding unit and the processing unit are electrically connected directly to the distribution board, without passing through the transformer, and wherein at least one electric apparatus selected from an inspection device, a personal computer, a fan, and a cleaner is/are connected to at least one of the power source sockets and is/are used.

2. The processing apparatus according to claim 1, wherein the power source sockets are disposed on a front side, a lateral side, or a rear side of the panel.

3. The processing apparatus according to claim 1, wherein the voltage of the power source sockets is any one of 100 V, 200 V, and 240 V.

4. The processing apparatus according to claim 1, wherein the external power source comprises a three-phase external power source.

5. The processing apparatus according to claim 4, wherein the voltage of the three-phase external power source is 200 V.

6. The processing apparatus according to claim 1, wherein the transformer is configured and arranged to convert three-phase AC power into single-phase AC power.

7. The processing apparatus according to claim 1, comprises one of a cutting unit including a rotatable cutting blade configured and arranged to cut the workpiece or a laser processing unit configured and arranged to perform laser processing on the workpiece or a grinding unit configured and arranged to grind the workpiece.

* * * * *